US006597271B2

(12) United States Patent
Busletta et al.

(10) Patent No.: US 6,597,271 B2
(45) Date of Patent: Jul. 22, 2003

(54) ELECTROMAGNETIC APPARATUS HAVING ADJUSTING EFFECTIVE CORE GAP

(76) Inventors: Galliano Riccardo Busletta, 3704 Poteet Dr., Apt. 828, Mesquite, TX (US) 75150; Robert Joseph Roessler, 935 W. Yellow Jacket La., Apt. 1007, Rockwall, TX (US) 75087; Karim Nashaat Wassef, 540 Buckingham Rd., Apt. 1125, Richardson, TX (US) 75081; Matthew Anthony Wilkowski, 2339 Heatherdale Dr., Mesquite, TX (US) 75150

( * ) Notice: Subject to any disclaimer, the term of this patent is extended or adjusted under 35 U.S.C. 154(b) by 105 days.

(21) Appl. No.: 09/976,814

(22) Filed: Oct. 12, 2001

(65) Prior Publication Data

US 2003/0071705 A1 Apr. 17, 2003

(51) Int. Cl.[7] ..... H01F 17/06

(52) U.S. Cl. ..... 336/178; 336/212; 336/134; 336/165

(58) Field of Search ..... 336/178, 83, 212, 336/165, 134, 233; 310/178, 218, 258

(56) References Cited

U.S. PATENT DOCUMENTS 3,954,434 A * 5/1976 Kobayashi ..... 65/43
4,513,273 A * 4/1985 Friedl ..... 336/55
4,668,886 A * 5/1987 Marandet et al. ..... 310/93
4,794,326 A * 12/1988 Friedl ..... 324/117 R
5,570,251 A * 10/1996 Shinoura et al. ..... 360/126

* cited by examiner

*Primary Examiner*—Anh Mai
(74) *Attorney, Agent, or Firm*—Law Office of Donald D. Mondul

(57) ABSTRACT

An electromagnetic apparatus having an adjusting effective core gap includes: (a) an electrical winding; and (b) a ferrous core situated proximal with the electrical winding. The core has a first terminus and a second terminus arranged in spaced relation to establish a gap distance between the termini in a region in substantial register with the termini. The winding and the core cooperate to establish an inductance related with an electrical current applied to the winding. At least one terminus of the termini has a configuration responsive to varying the current by effecting selective local saturation of successive portions of the at least one terminus for successive values of the current. The selective local saturation establishes successive new effective gap distances. Each respective new effective gap distance is appropriate for establishing a successive new optimum inductance for the current value then extant.

12 Claims, 7 Drawing Sheets

10

40

70

ELECTROMAGNETIC APPARATUS HAVING ADJUSTING EFFECTIVE CORE GAP

BACKGROUND OF THE INVENTION

The present invention is directed to electromagnetic apparatuses that include a core structure. The relationship between inductance and current for an electromagnetic apparatus that includes a core is a measure of the performance of the apparatus. The inductance vs. current relationship varies from apparatus to apparatus as features of the structure change, especially as the core material changes and as the gap in the core changes.

It would be useful to be able to extend the usable current range for a particular core structure and still maintain acceptable inductance vs. current performance of an electromagnetic apparatus that includes the core structure. Such an extension of usable current range for a core structure facilitates handling over-design currents (e.g., transients or high ripple). Such an extension would also facilitate an adapting saturation characteristic of the core to the optimum flat gapped core characteristic at a specific current under normal operating conditions.

The structure of the adjusting effective gap of the present invention is applicable to any gap in any material. It is most useful in ferrite cores where a hard saturation characteristic often prohibits use of such ferrite cores above a proscribed current limit. The adjusting effective gap structure of the present invention is useful for mitigating loss of inductance caused by saturation or by inappropriate gap structure and can be adapted to any core shape and size.

SUMMARY OF THE INVENTION

An electromagnetic apparatus having an adjusting effective core gap includes: (a) an electrical winding; and (b) a ferrous core situated proximal with the electrical winding. The core has a first terminus and a second terminus arranged in spaced relation to establish a gap distance between the first terminus and the second terminus in a region in substantial register with the first terminus and the second terminus. The winding and the core cooperate to establish an inductance related with an electrical current applied to the winding. At least one terminus of the first terminus and the second terminus has a configuration responsive to varying the current by effecting selective local saturation of successive portions of the at least one terminus for successive values of the current. The selective local saturation establishes successive new effective gap distances. Each respective new effective gap distance is appropriate for establishing a successive new optimum inductance for the current value then extant.

It is an object of the present invention to provide an electromagnetic apparatus having an adjusting effective core gap able to extend the usable current range for a particular core structure and still maintain acceptable inductance vs. current performance of the electromagnetic apparatus.

Further objects and features of the present invention will be apparent from the following specification and claims when considered in connection with the accompanying drawings, in which like elements are labeled using like reference numerals in the various figures, illustrating the preferred embodiments of the invention.

DETAILED DESCRIPTION OF THE PREFERRED EMBODIMENT

Providing a gap in the core of an electromagnetic device expands the usability of the core to higher currents at the cost of reduced inductance. Adding an air gap increases the reluctance of the magnetic path, thereby reducing the flux density in the core. The result is a reduced effective permeability and inductance at higher currents. Such a result of adding a gap in the magnetic path of an electromagnetic device is regarded as acceptable because the field intensity established by high currents would saturate an ungapped core. However, once the flux in a gapped core exceeds the saturation limit of the core material, the core saturates into an effective air-core. A result of such saturation is an unacceptably drastic reduction in inductance making the electromagnetic device unusable. Such a drastic reduction in inductance is especially likely to occur in ferrite cores where a hard saturation characteristic limits their operational current range.

Figure 1:
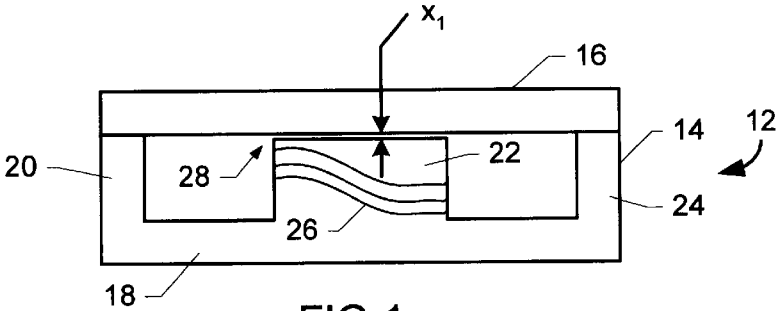
FIG. 1 (PRIOR ART)
FIG. 1 is a side elevation schematic view of a first exemplary prior art core structure.
Figure 2:
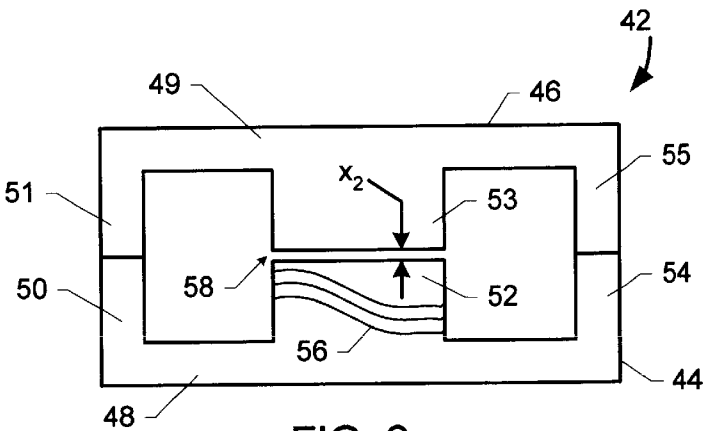
FIG. 2 (PRIOR ART)
FIG. 2 is a side elevation schematic view of a second exemplary prior art core structure.
Figure 3:
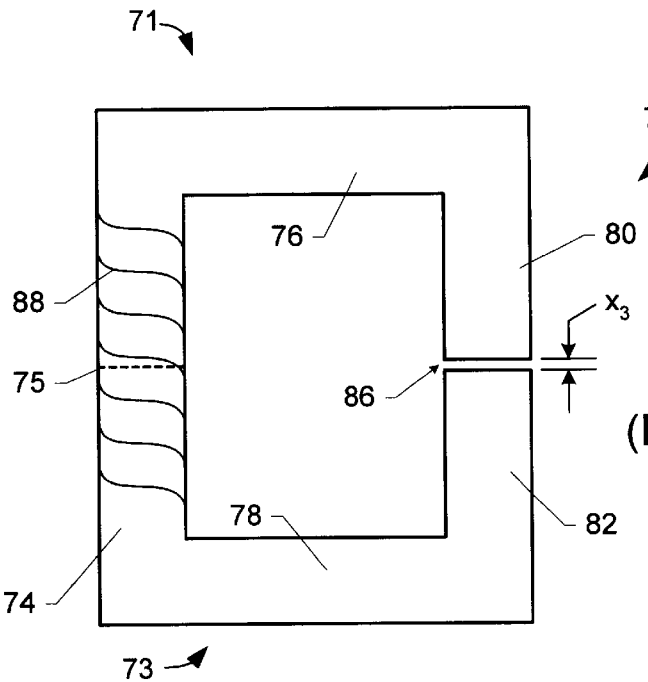
FIG. 3 (PRIOR ART)
FIG. 3 is a side elevation schematic view of a third exemplary prior art core structure.

FIGS. 1–3 are side elevation schematic views of exemplary prior art core structures employing flat gap construction. Flat gapping is introduced into a core by creating a volume of air in the path of the flux at a flat interface surface. For example, in an E-I core construction (FIG. 1), the flat gap is a volume of air in the center-post. A standard flat-gapped core is limited to a design current range where the inductance is constant. At currents above the design current range, the core begins to saturate. While ferrite cores will usually saturate based on a specific B-H (B: flux density; H: magnetic field intensity) characteristic (such as squareness of a B-H response curve), the current limit for a core is often approximated as a step reduction in inductance. The hard saturation characteristic of a ferrite core makes it unusable at current ranges beyond its maximum design current. This is generally acceptable since core gap selection is limited to constant inductance operation, and intrusion into the saturation mode of the core is considered undesirable when using ferrite cores.

The inductance and current limit of a core can be calculated as $$L = \frac{N_t^2}{R_{core} + R_{gap}} \quad [1]$$

$$I_{\max} = \frac{N_t A_g B_{\max}}{L} \quad [2]$$

The core and gap reluctances are defined as $$R_{core} = \frac{l_c}{\mu_o \mu_r A_e} \quad [3]$$

$$R_{gap} = \frac{l_g}{\mu_o A_g} \quad [4]$$

where $N_t$: Number of turns.

$B_{max}$: Saturation Flux Density Limit.

$R_{core}$: Reluctance of the core.

$R_{gap}$: Reluctance of the gap.

$l_e$: Effective core length.

$l_g$: Gap length (height of the gap).

$A_e$: Effective core area.

$A_g$: Gap area (cross-section of the gap).

$\mu_r$: Relative permeability of the core material.

$\mu_o = 4\pi \times 10^{-7}$ H/m: Permeability of vacuum.

By varying the gap length $l_g$, the core inductance and current limit can be adjusted to a particular application's range.

FIG. 1 is a side elevation schematic view of a first exemplary prior art core structure. In FIG. 1, an electromagnetic device 10 includes an E-I core structure 12 with an E-shaped core component 14 and an I-shaped core component 16. E-shaped core component 14 has a base member 18 and legs 20, 22, 24 extending from base member 18. Legs 20, 22, 24 are generally polyhedron-shaped or cylindrically-shaped and are typically integrally formed with base member 18. A winding structure 26 is arrayed upon E-shaped core component 14, typically arranged about center leg 22. A time-varying electrical current is applied to winding structure 26 (details not shown in FIG. 1) for establishing an inductance in electromagnetic device 10. I-shaped core component 16 is situated substantially in register with E-shaped core component 14 resting in an abutting relationship with legs 20, 24. E-shaped core component 14 and I-shaped core component 16 establish a magnetic circuit path via legs 20, 22, 24 and base member 18. A gap 28 is established between leg 22 and I-shaped core component 16. Gap 28 has a gap distance "$x_1$" between leg 22 of E-shaped core component 14 and I-shaped core component 16.

FIG. 2 is a side elevation schematic view of a second exemplary prior art core structure. In FIG. 2, an electromagnetic device 40 includes an E-E core structure 42 with a first E-shaped core component 44 and a second E-shaped core component 46. First E-shaped core component 44 has a base member 48 and legs 50, 52, 54 extending from base member 48. Legs 50, 52, 54 are generally polyhedron-shaped or cylindrically-shaped and are typically integrally formed with base member 48. A winding structure 56 is arrayed upon first E-shaped core component 44, typically arranged about center leg 52. A time-varying electrical current is applied to winding structure 56 (details not shown in FIG. 2) for establishing an inductance in electromagnetic device 40. Second E-shaped core component 46 has a base member 49 and legs 51, 53, 55 extending from base member 49. Legs 51, 53, 55 are generally polyhedron-shaped or cylindrically-shaped and are typically integrally formed with base member 49. Second E-shaped core component 46 is situated substantially in register with first E-shaped core component 44 with legs 50, 51 and legs 54, 55 in an abutting relationship. Winding structure 56 may be arranged about either center leg 52, 53 or both of center legs 52, 53. First E-shaped core component 44 and second E-shaped core component 46 establish a magnetic circuit path via legs 50, 51, 52, 53, 54, 55 and base members 48, 49. A gap 58 is established between legs 52, 53. Gap 58 has a gap distance "$x_2$" between legs 52, 53.

FIG. 3 is a side elevation schematic view of a third exemplary prior art core structure. In FIG. 3, an electromagnetic device 70 includes a C-shaped core structure 72 with a base member 74 and legs 76, 78 extending from base member 74. Legs 76, 78 are typically integrally formed with base member 74. Additional legs 80, 82 extend from legs 76, 78 toward each other to establish a gap 86 between legs 80, 82. Legs 80, 82 are typically integrally formed with legs 76, 78. A winding structure 88 is arrayed upon base member 74. A time-varying electrical current is applied to winding structure 88 (details not shown in FIG. 3) for establishing an inductance in electromagnetic device 70. The integral structure of electromagnetic device 70 establishes a magnetic circuit path via legs 76, 78, 80, 82 and base member 74. Gap 86 has a gap distance "$x_3$" between legs 80, 82.

Alternatively, C-shaped core structure 72 may be fashioned of two U-shaped core structures 71, 73, as indicated by dotted line 75 in FIG. 3. Using such a configuration a magnetic circuit path via legs 76, 78, 80, 82 and base member 74 is still established so long as U-shaped core structures 71, 73 are in an abutting relationship at dotted line 75.

Figure 4:
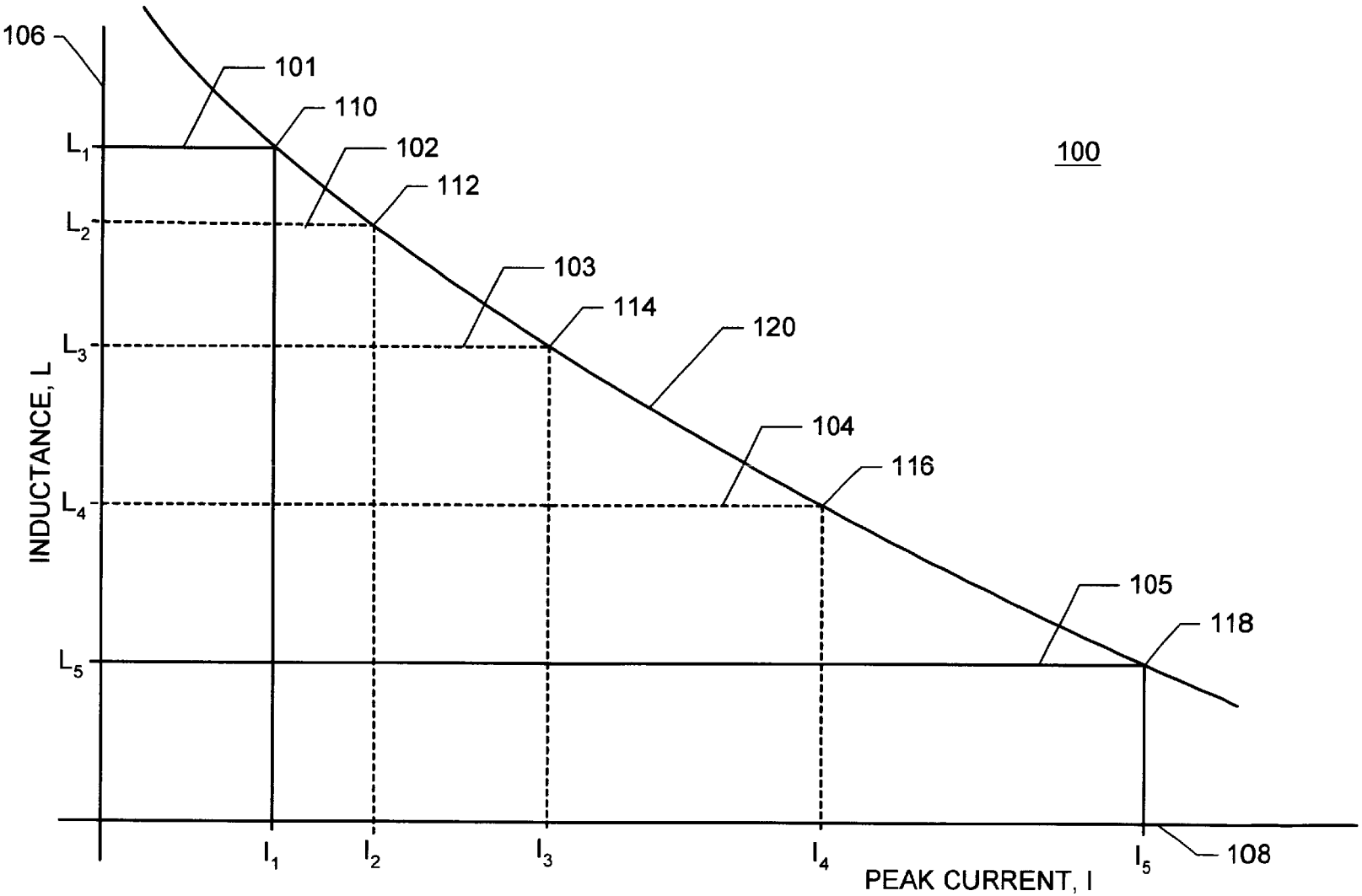
FIG. 4 is a graphic representation of the relationship of inductance and current for a variety of gap distances for a given core structure.

FIG. 4 is a graphic representation of the relationship of inductance and current for a variety of gap distances for a given core structure. In FIG. 4, a graphic plot 100 plots inductance L for an electromagnetic device (e.g., electromagnetic devices 10, 40, 70; FIGS. 1-3) on an axis 106 as a function of peak value of a time-varying current I applied to a winding in the electromagnetic device on an axis 108. Examples of a time-varying current include an alternating current or a differential current. Several response curves are plotted in FIG. 4, as will be explained, indicating a particular representative electromagnetic device having a given core material and other features, indicating responses using different core gaps for the representative device.

FIG. 4 illustrates that inductance L decreases significantly as winding current I increases above a predetermined value. It is at the predetermined value of winding current I that the core in the electromagnetic device represented by the particular response curve saturates, and inductance L of the electromagnetic device precipitously decreases. The response curves illustrated in FIG. 4 are schematic curves indicating a virtually perpendicular drop in inductance at saturation currents. Actual response curves are often shaped less geometrically, but the geometrically perpendicular curves in FIG. 4 are illustrative of the pertinent aspects of the present invention for the sake of simplicity of explanation.

A first response curve 101 indicates inductance remaining constant at a level $L_1$ within a range of currents from zero to $I_1$ (saturation current). At saturation current $I_1$ inductance L drops toward zero. Thus, L-I response curve 101 illustrates the L-I characteristic for an electromagnetic device having a particular core and particular configuration including a first core gap distance (e.g., gap distances $x_1$, $x_2$, $x_3$; FIG. 1–3). An optimum L-I value for L-I response curve 101 occurs at an optimum L-I locus 110.

A second response curve 102 indicates inductance remaining constant at a level $L_2$ within a range of currents from zero to $I_2$ (saturation current). At saturation current $I_2$ inductance L drops toward zero. Thus, L-I response curve 102 illustrates the L-I characteristic for an electromagnetic device having the same particular core and particular configuration associated with L-I response curve 101, but having a second core gap distance that is larger than the first core gap distance associated with L-I response curve 101. An optimum L-I value for L-I response curve 102 occurs at an optimum L-I locus 112.

A third response curve 103 indicates inductance remaining constant at a level $L_3$ within a range of currents from zero to $I_3$ (saturation current). At saturation current $I_3$ inductance L drops toward zero. Thus, L-I response curve 103 illustrates the L-I characteristic for an electromagnetic device having the same particular core and particular configuration associated with L-I response curves 101, 102 but having a third core gap distance that is larger than the second core gap distance associated with L-I response curve 102. An optimum L-I value for L-I response curve 103 occurs at an optimum L-I locus 114.

A fourth response curve 104 indicates inductance remaining constant at a level $L_4$ within a range of currents from zero to $I_4$(saturation current). At saturation current $I_4$ inductance L drops toward zero. Thus, L-I response curve 104 illustrates the L-I characteristic for an electromagnetic device having the same particular core and particular configuration associated with L-I response curves 101, 102, 103 but having a fourth core gap distance that is larger than the third core gap distance associated with L-I response curve 103. An optimum L-I value for L-I response curve 104 occurs at an optimum L-I locus 116.

A fifth response curve 105 indicates inductance remaining constant at a level $L_5$ within a range of currents from zero to $I_5$(saturation current). At saturation current $I_5$ inductance L drops toward zero. Thus, L-I response curve 105 illustrates the L-I characteristic for an electromagnetic device having the same particular core and particular configuration associated with L-I response curves 101, 102, 103, 104 but having a fifth core gap distance that is larger than the fourth core gap distance associated with L-I response curve 104. An optimum L-I value for L-I response curve 105 occurs at an optimum L-I locus 118.

The areas under the various response curves 101, 102, 103, 104, 105 remain constant for the different gap distances, indicating that the flux handling capacity of the core is unchanged. The (L, I) values for the various L-I loci 110, 112, 114, 116, 118 are determined by the relationship:

$$L_n I_{max} = K \quad [5]$$

where, K=a constant for a given core material, core geometry and number of winding turns;

$I_{max}$=peak current at a particular L-I locus; and $L_n$=inductance at the particular L-I locus.

FIG. 4 illustrates L-I response curves for several core gap distances. Various core gap distances may be appropriate for use with different applications or products. An electromagnetic device having a core that may present a range of effective core gap distances would be advantageous because such a device would be available for use with a variety of products. Such an increased range of applicability for a particular device contributes to greater business efficiency by an ability to manufacture fewer models of an electromagnetic device for use in the same various products that required a greater number of models before. Requiring such a smaller model count to be able to address the same array of applications means business efficiencies, or economies manifested as fewer retooling operations, fewer parts to account for and inventory, fewer components and raw materials to stock for manufacturing the devices and fewer models to track and advertise for sales, marketing, shipping and warranty operations. Other economies may be manifested in various operations including manufacturing, purchasing, inventory, sales, marketing, advertising and other business activities.

In FIG. 4, an aggregate L-I response curve 120 illustrates a continuum that includes optimum L-I loci 110, 112, 114, 116, 118. An electromagnetic device having a capability to establish a variety of effective core gaps to accommodate a continuum of optimum L-I loci as represented by aggregate L-I response curve 120 would provide significant business economies. A ferrite core with a single flat gap (e.g., electromagnetic devices 10, 40, 70; FIGS. 1–3) would not be able to capture the full dynamics of the multi-gap range that would be provided by such an adjusting gap capability.

Figure 5:
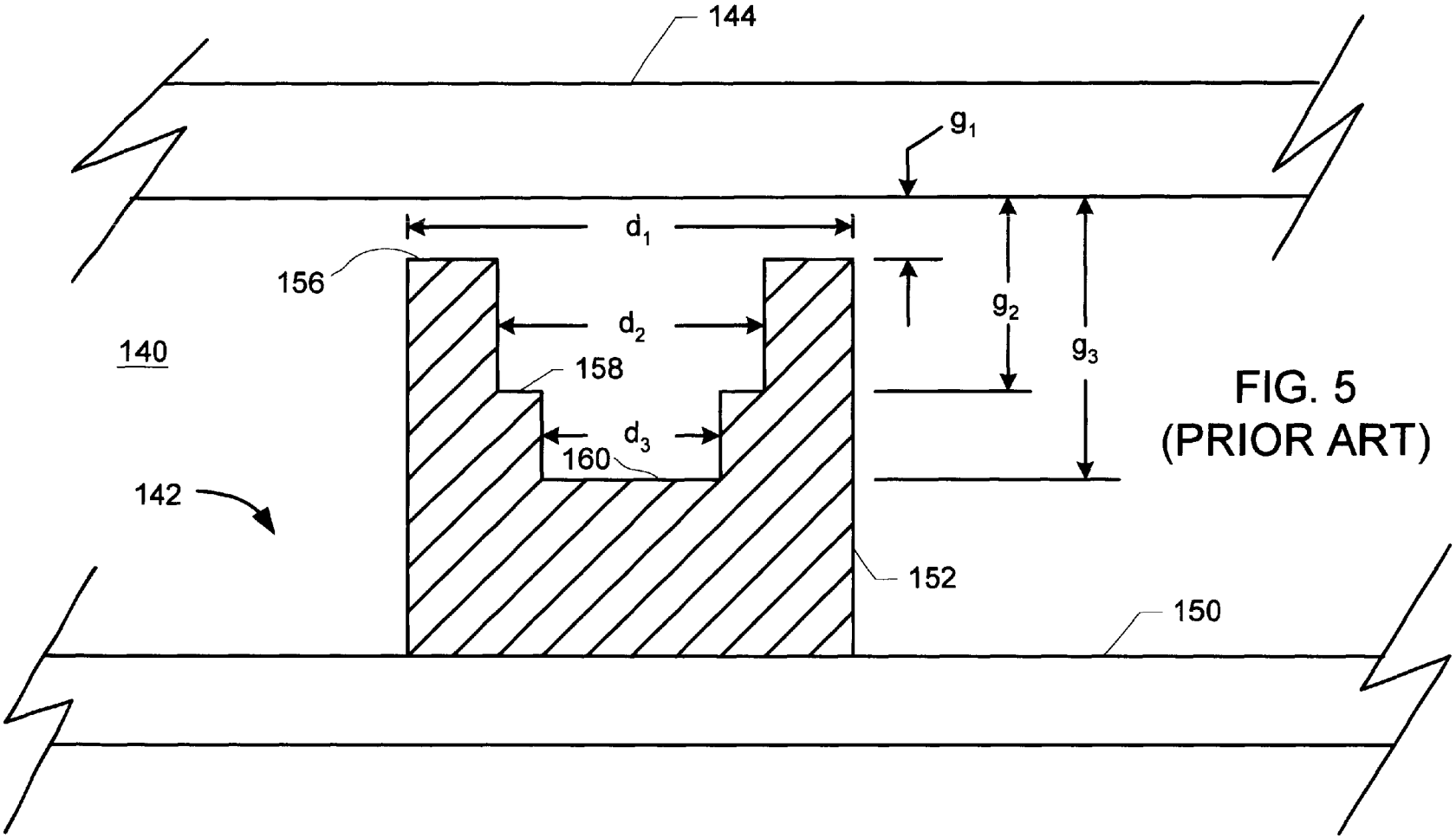
FIG. 5 (PRIOR ART)
FIG. 5 is a schematic partial section view of a fourth exemplary prior art core structure having a stepped gap arrangement.

FIG. 5 is a schematic partial section view of a fourth exemplary prior art core structure having a stepped gap arrangement. The core construction illustrated in FIG. 5 is an example of an attempt to achieve the capability of providing an adjusting core structure for an electromagnetic device. In FIG. 5, a core component 140 includes a first core portion 142 and a second core portion 144. First core portion 142 includes a base member 150 and a post member 152. Post member 152 is a substantially polyhedral or cylindrical post integrally formed with base member 150 and extending from base member 150 toward second core portion 144. Post member 152 is illustrated in FIG. 5 in section generally along a diameter of post member 152.

Post member 152 is in spaced relation with second core portion 144 and establishes a first gap distance $g_1$ between post member 152 and second core portion 144. Post member 152 is configured with a tiered construction establishing a first level 156 having a first diameter $d_1$, a second level 158 having a second diameter $d_2$ and a third level 160 having a third diameter $d_3$. When winding current in a winding associated with post member 152 (e.g., applied to windings 26, 56, 88; FIGS. 1–3) rises to an appropriate current level, post member 152 will partially saturate from first level 156 to second level 158 to establish a new effective gap distance $g_2$ between second level 158 of post member 152 and second core portion 144. When winding current in the winding associated with post member 152 further rises to a second appropriate current level, post member 152 will further partially saturate from second level 158 to third level 160 to establish another new effective gap distance $g_3$ between third level 160 of post member 152 and second core portion 144. This selective saturation of a core component 140 is a crude attempt at adjusting an effective core gap distance that succeeds only in effecting a selection among a few discrete response curves on a plot of the sort described in connection with FIG. 4. That is, for example, first level 156 of post member 152 may establish an appropriate gap distance $g_1$ to cause core component 140 to respond according to L-I response curve 101 (FIG. 4). By way of further example, second level 158 of post member 152 may establish an appropriate effective gap distance $g_2$ to cause core component 140 to respond according to L-I response curve 103 (FIG. 4). By way of further example, third level 160 of post member 152 may establish an appropriate effective gap distance $g_3$ to cause core component 140 to respond according to L-I response curve 105 (FIG. 4). No true adjustment along a continuum (e.g., aggregate L-I response curve 120 (FIG. 4) is effected by the discrete approach provided by core component 140 (FIG. 5).

In the design of magnetic components, it would be desirable to have a core that can operate at the highest possible L-I level (FIG. 4) for a given peak current. Such a core must adapt to increased winding current and its attendant increasing flux by reducing its inductance sufficiently to allow a pre-saturation flux to flow. Such a core would operate as an adjusting core that would be capable of accommodating various winding currents and could handle high current loads without complete failure. One approach to analyzing and designing such an adjusting core would be to introduce multiple step gaps in order to simulate the gradual saturation of the gaps. Such a solution would be constructed using a structure similar to core component 140 (FIG. 5). A preferred optimal design would capture the full dynamic L-I range of the core to effect true adjustment along a continuum (e.g., aggregate L-I response curve 120 (FIG. 4).

Figure 6:
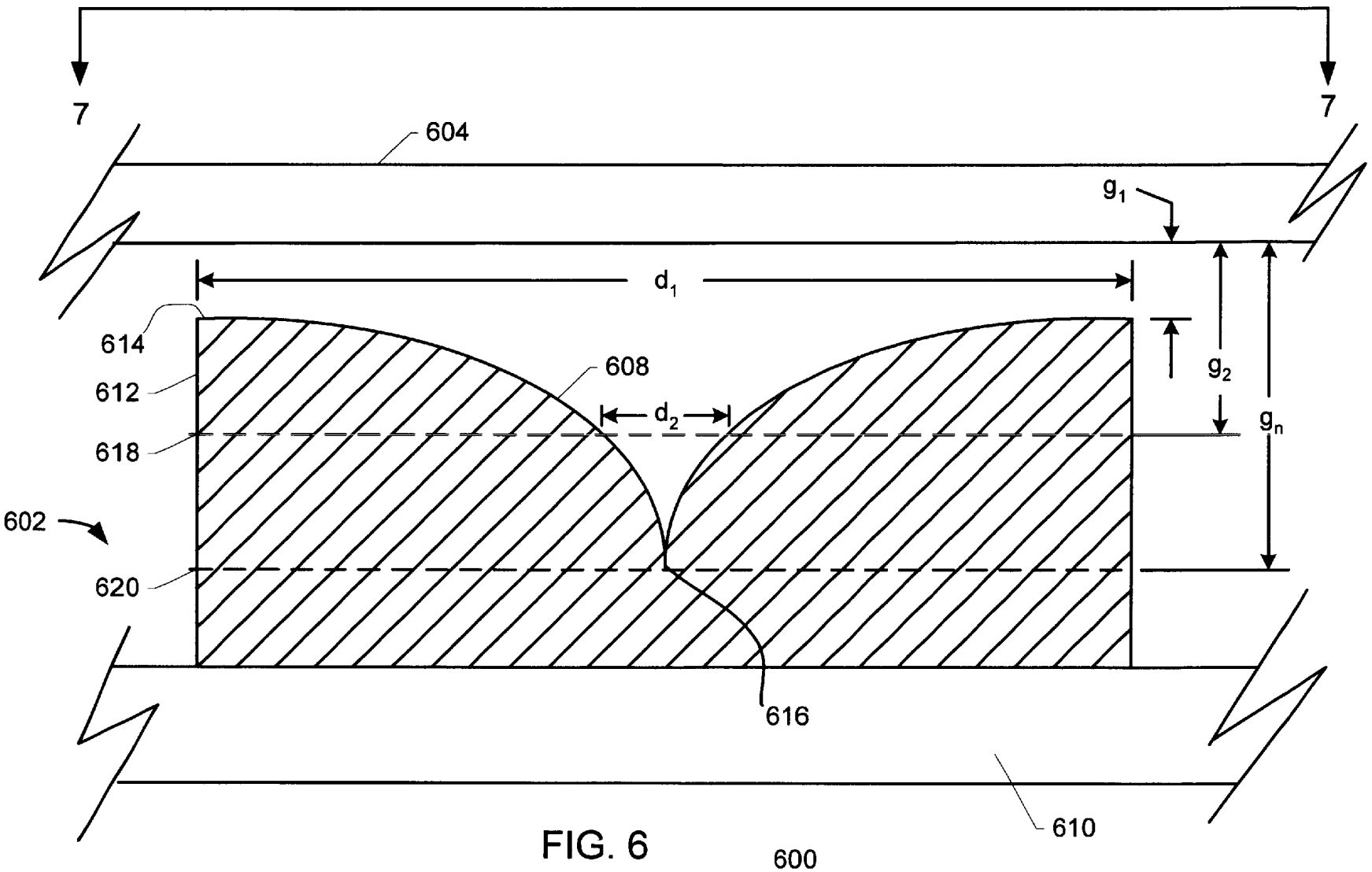
FIG. 6 is a side elevation schematic view of the preferred embodiment of the adjusting effective core structure of the present invention.

FIG. 6 is a side elevation schematic view of the preferred embodiment of the adjusting effective core structure of the present invention. In FIG. 6, a core component 600 includes a first core portion 602 and a second core portion 604. First core portion 602 includes a base member 610 and a post member 612. Post member 612 is a substantially cylindrical post integrally formed with base member 610 and extending from base member 610 toward second core portion 604. Post member 612 may be configured in a polyhedron-shaped structure or as a substantially planar structure. For ease of explaining the operation of the present invention, post member 612 is illustrated in FIG. 6 as a cylindrical structure. Post member 612 is illustrated in FIG. 6 in section generally along a diameter of post member 612.

Post member 612 is in spaced relation with second core portion 604 and establishes a first gap distance $g_1$ between post member 612 and second core portion 604. That is, post member 612 presents a first terminus, or structure, and second core portion 604 presents a second terminus, or structure, to establish first gap distance $g_1$ between post member 612 and second core portion 604. Post member 612 is configured with a variable depth construction establishing a first level 614 having a first diameter $d_1$. Post member 612 continuously varies its effective diameter to substantially zero along a continuous variance surface 608 to establish a maximum gap distance $g_n$ when the effective diameter is zero, substantially at center 616 of post structure 604. The subscript "n" is intended to emphasize that continuous variance surface 608 is not stepped, and an infinite number of gap distances $g_n$ may be achieved because of that continuous structure.

When winding current in a winding associated with post member 612 (e.g., applied to windings 26, 56, 88; FIGS. 1–3) rises to an appropriate current level, post member 612 will locally, or partially saturate from first level 614 to a second level lower than first level 614. By way of example, post member 612 may continuously vary its effective diameter along continuous variance surface 608 to second level 618 to establish an effective second gap distance $g_2$ when the effective diameter is $d_2$. That is, there is formed in post structure 612 an annulus or ring structure (FIG. 7) displaced from second core structure 604. The annulus structure has a span equal with the distance $$\frac{(d_1 - d_2)}{2}.$$

It is this annulus structure that establishes magnetic coupling at an effective gap $g_2$ between post member 612 and second core portion 604. Given the continuous structure of variance surface 608 (i.e., variance surface 608 is not a stepped structure) any diameter between diameter $d_1$ and zero diameter, including diameter $d_2$, may be established to form respective annuli structures in post member 612, each respective annulus structure having a respective span $$\frac{(d_1 - d_n)}{2}$$

and being separated from second core structure 604 by a respective effective gap distance $g_n$ without experiencing discrete diameter and effective gap distance changes. Such discrete diameter and effective gap distance changes would be experienced if variance surface 608 were fashioned in a stepped, non-continuous structure. In contrast with prior art attempts at adjusting effective gap core structures (e.g., core component 140, FIG. 5), true adjustment along a continuum (e.g., aggregate L-I response curve 120 (FIG. 4) is effected by post member 612 continuously varying its effective annular span $\Delta_{n-1}$ for respective gaps $g_n$ having respective diameters $d_n$ along continuous variance surface 608.

Figure 7:
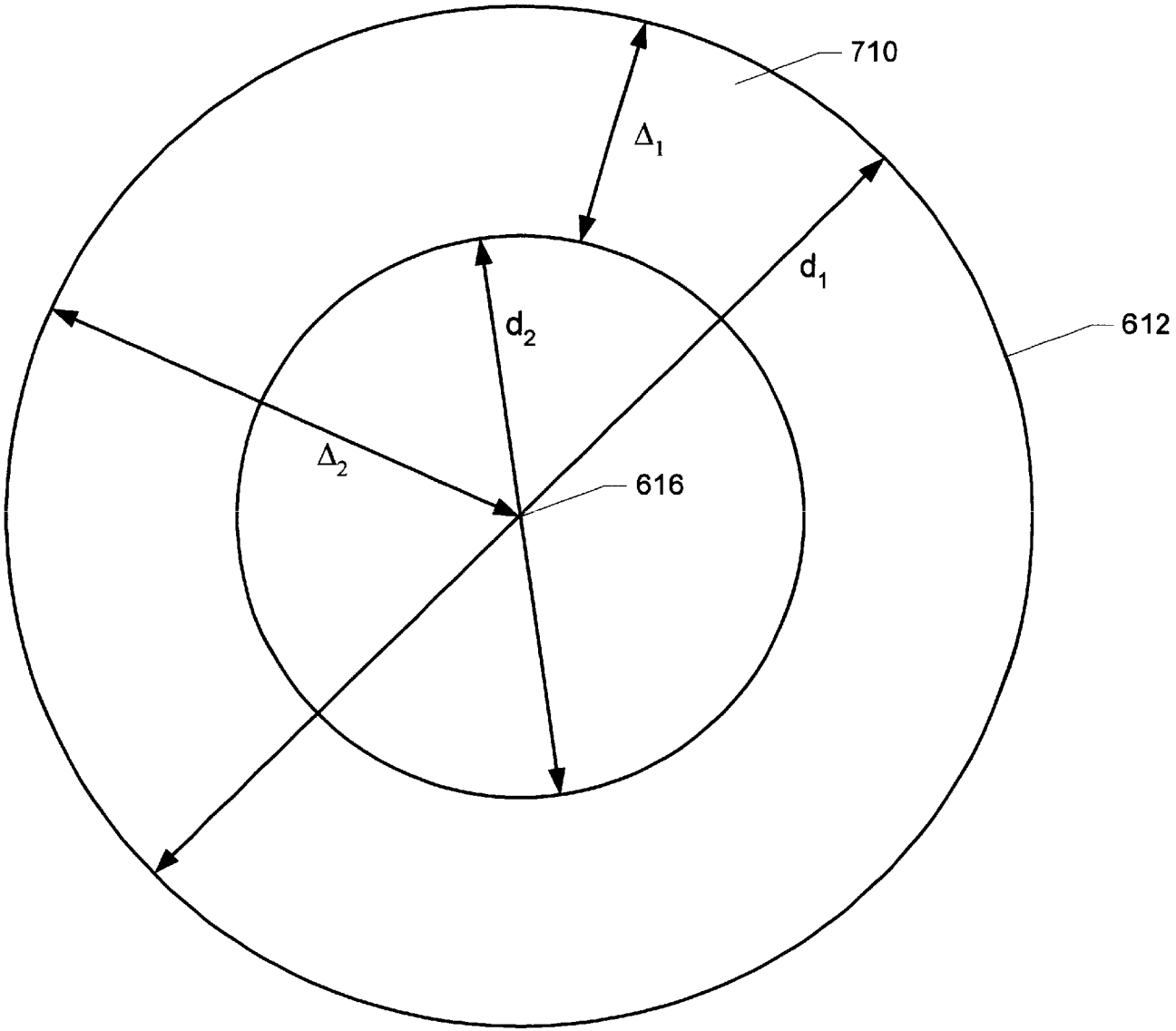
FIG. 7 is a schematic top view of the core structure illustrated in FIG. 6, taken from viewpoint 7—7 in FIG. 6, to indicate annuli established when partially saturating the core structure illustrated in FIG. 6.

FIG. 7 is a schematic top view of the core structure illustrated in FIG. 6, taken from viewpoint 7—7 in FIG. 6, to indicate annuli established when locally, or partially saturating the core structure illustrated in FIG. 6. In FIG. 7 second core portion 604 (FIG. 6) is omitted to permit a top view of post member 612. In FIG. 7, a post member 612 is symmetrically oriented about a center 616. Post member 612 has a diameter $d_1$. As described in connection with FIG. 6, when winding current in a winding associated with post member 612 (not shown in FIG. 7) rises to an appropriate current level, post member 612 will locally saturate from a first level 614 to a second level, for example a level indicated by dashed line 618 that is lower than first level 614 (FIG. 6). At second level 618 an effective gap distance $g_2$ is established in an annulus 710 (FIG. 7). Annulus 710 has a span $$\Delta_1 = \frac{(d_1 - d_2)}{2}.$$

A further increase in winding current in a winding associated with post member 612 further locally saturates post member 612 to a level lower than level 618 to establish another annulus (not shown in FIG. 7) having a greater span. As explained in connection with FIG. 6, the continuous structure of variance surface 608 allows establishment of substantially any diameter between diameter $d_1$ and zero to form respective annuli structures (e.g., annulus 710; FIG. 7) in post member 612. Each respective annulus has a respective span $$\Delta_{n-1} = \frac{(d_1 - d_n)}{2},$$

and being separated from second core structure 604 by a respective effective gap $g_n$ without experiencing discrete changes in diameter and effective gap distances.

Step gaps (e.g., core component 140, FIG. 5) are a simple structure for softening the saturation characteristic of conventional ferrite cores. An optimal adjusting effective gap shape preferably should capture the full dynamic range of the flux capacity curve of a core. In order to achieve this, the core must partially saturate until the inductance has dropped to a point that stops further saturation at the effective gap's effective cross-sectional area (i.e., the area of the annulus structure established in the post member by a given effective diameter).

The first step in modeling the adjusting effective gap is to approximate the effective gap structure as multiple step gaps of finite dimension. The analysis is then extended to determine a desired smooth curve structure.

Figure 8:
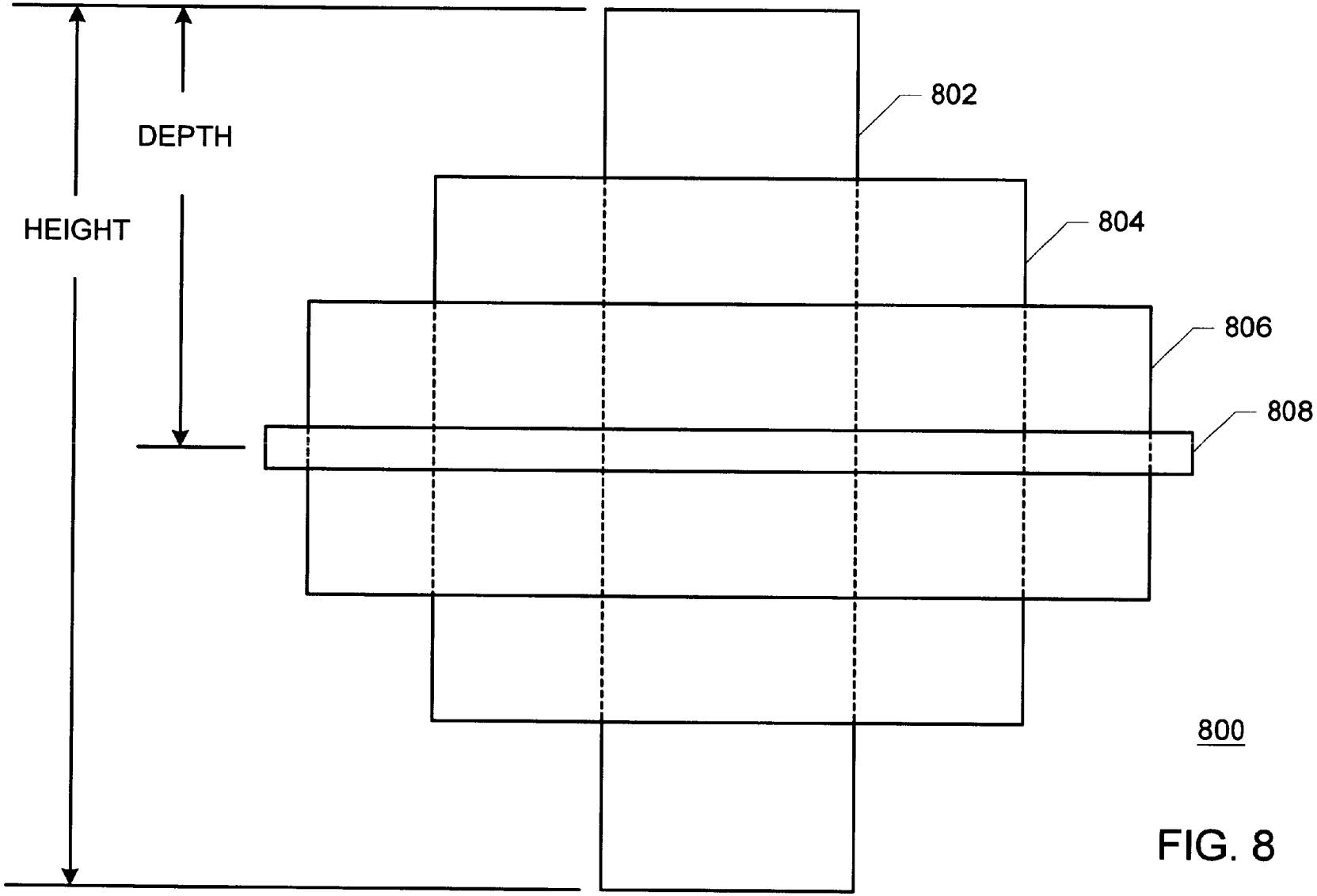
FIG. 8 is a side view of the model employed for developing the continuous effective core gap distance variance structure of the present invention.

FIG. 8 is a side view of the model employed for developing the continuous effective core gap distance variance structure of the present invention. In FIG. 8, a model air cylinder structure 800 includes cylinders 802, 804, 806, 808 in a substantially concentric nested arrangement. Model air cylinders are used to represent gap volumes in the finished structure. Using such a modeling approach, the finished core structure will include a plurality of core segments that substantially conform with portions of the air gap cylinders that are modeled. Model air cylinder structure 800 has a height and a depth as indicated in FIG. 8.

The reluctance method of determining inductance and current saturation is employed in the exemplary analytic development, so the same equations introduced above for describing a flat gapped core are applicable for developing the adjusting core gap structure of the present invention (i.e., expressions [1]–[5]). The exemplary core gap chosen to describe the invention is circularly symmetric; a similar design approach may be easily used for other core gap shapes, including polyhedron-shaped core structures and substantially plane core structures. The adjustable effective core structure is therefore modeled as multiple concentric cylindrical air gap components 802, 804, 806, 808 whose effects may be described using the analogy of parallel flux path reluctances.

A shape function $f(x)$ is developed for the analysis. Any function may be used provided that:

$$0 \leqq x \leqq 1$$

$$0 \leqq f(x) \leqq 1$$

This general form allows for multiple peaks and troughs between the center and outside radius of the gap. Because the effect of multiple gap peaks can be considered an extension of the effect of a single peak, the gap face curvature is defined for a variation between a single maximum to a single minimum. For this analysis, an exemplary general power function of the form:

$$f(x) = \left(\frac{x^{p_1} - x_{\min}^{p_1}}{x_{\max}^{p_1} - x_{\min}^{p_1}}\right)^{p_2} \quad [6]$$

is used. When the minimum and maximum positions are set at the center and outer radius of the center-post, the function simplifies to:

$$f(x) = (1 - x^{p_1})^{p_2} \quad [7]$$

so that the range of possible curvatures can be determined as a function of the two power terms $p_1$ and $p_2$.

The depth of the gap can be defined as a function of radial position:

$$d(r) = d_o + f\left(\frac{r}{r_{\max}}\right) \cdot (d_{full} - d_o) \quad [8]$$

where $0 \leqq r \leqq r_{max}$ $r_{max}$: radius of the center-post.

$d_o$: minimum gap depth (measured from the center of the core).

$d_{full}$: maximum gap depth (measured from the center of the core).

For this exemplary description of the adjusting core gap structure of the present invention, the gap height is defined as twice the gap depth.

$$l(r) = 2 \cdot d(r) \quad [9]$$

The cross-sectional area of each cylinder 802, 804, 806, 808 is approximated for a small radial thickness dr:

$$a(r) = 2\pi r dr \quad [10]$$

Saturation can be determined as a response to the shape function represented by expression [7]. The index "i" is used to denote a saturation level. The gap depth can therefore be represented as:

$$d_i(r) = \begin{cases} d_o + f\left(\frac{r}{r_{\max}}\right) \cdot (d_{full} - d_o) & r < r_i \\ d_o + f\left(\frac{r_1}{r_{\max}}\right) \cdot (d_{full} - d_o) & r \geq r_i \end{cases} \quad [11]$$

The reluctance of the adjusting gap can be expressed as the parallel sum of "n" concentric air cylinders:

$$R_{gap} = \frac{1}{\frac{1}{R_1} + \frac{1}{R_2} + \ldots + \frac{1}{R_j} + \ldots + \frac{1}{R_n}} = \frac{1}{\mu_o}\left(\frac{a_1}{l_1} + \frac{a_2}{l_2} + \ldots + \frac{a_i}{l_j} + \ldots + \frac{a_n}{l_n}\right)^{-1} = \frac{2}{\mu_o}\left(\sum_{j=1}^{n} \frac{a_j}{d_j}\right)^{-1} \quad [12]$$

$$R_{gap} = \frac{2}{\mu_o}\left(\int_0^{r_{\max}} \frac{a(r)}{d(r)} dr\right)^{-1} \quad [13]$$

-continued $$R_{gap_i} = \frac{2}{\mu_o}\left[\int_0^{r_i} \frac{2\pi r}{d_o + f\left(\frac{r}{r_{\max}}\right)\cdot(d_{full} - d_o)} dr + \int_{r_i}^{r_{\max}} \frac{2\pi r}{d_o + f\left(\frac{r_i}{r_{\max}}\right)\cdot(d_{full} - d_o)} dr\right]^{-1} \quad [14]$$

The first integral in expression [14] is dependent on the shape function f(x); the second integrand is a linear function of radius. The overall effective cross-sectional area of the saturated core gap is expressed as:

$$C_i = \pi(r_{max}^2 - r_i^2) \quad [15]$$

The inductance and current levels for a particular saturation level "i" may be expressed as:

$$L_i = \frac{N_t^2}{R_{core} + \frac{2}{\mu_o}\left[\int_0^{r_i} \frac{2\pi r}{d_o + f\left(\frac{r}{r_{\max}}\right)\cdot(d_{full} - d_o)} dr + \left[\int_{r_i}^{r_{\max}} \frac{2\pi r}{d_o + f\left(\frac{r_i}{r_{\max}}\right)\cdot(d_{full} - d_o)} dr\right]^{-1}\right.} \quad [16]$$

$$I_i = \frac{N_t C_i \cdot B_{\max}}{L_i} \quad [17]$$

Using $r_i$ as the variable indicator of saturation level i, a range of inductance-current (L-I) curves as functions of various inputs may be determined. Varying the depth and shape profile for a particular air gap will produce families of L-I curves (similar to FIG. 4) to indicate the best adjustable effective core gap shape. In order to determine the gap shape that captures the dynamic range of the flux capacity curve of the core, the shape function power terms $p_1$ and $p_2$ may be varied and a figure of merit for the L-I result may be determined.

In order to determine the optimum combination of powers in the power function employed in design of the adjustable effective core gap structure (e.g., expression [7]) to generate an adjustable effective core gap capable of capturing the flux capacity of the core, combinations of the powers are analyzed and a figure of merit (FOM) is used to determine the optimum shape profile. Since the flux capacity of the core exhibits the highest area under the L-I curve (FIG. 4), the FOM used may be of the form:

$$FOM = \int L dI \quad [18]$$

There is a family of gap contours that demonstrate optimum adjustable effective core gap performance. Recall that optimum L-I response for a given core for various core gaps may be represented by an aggregate optimum L-I response curve, such as curve 120 in FIG. 4. The shapes determined by the family of gap contours for the exemplary adjustable effective cylindrical gap structure have been determined by the inventors to all exhibit a sharp indentation or "dimple" gap. By determining the peak FOM point using expression [18], one can ascertain the power factors ($p_1$, $p_2$) that are required for producing the optimum design for the adjusting core gap. Nonlinear effects may also affect the desired gap profile. Further refinement of the apparatus of the present invention may be able to improve even further upon the performance of a core structure.

Finite element analysis may be carried out to allow the inclusion of fringing field effects in considering an adjusting core gap design. Because of the gradual saturation of the adjusting core gap, fringing fields would be highly dependent on the current level applied to the core. At low currents, most of the gap would be enclosed by ferrite (e.g., proximal locus 614; FIG. 6). However, at higher current levels an adjusting core gap may be less enclosed by unsaturated ferrite (e.g., at depth 618; FIG. 6) and fringing fields would begin to grow as a function of the gap shape until the gap saturated to an effective flat gap (e.g., at depth 620; FIG. 6).

Figure 9:
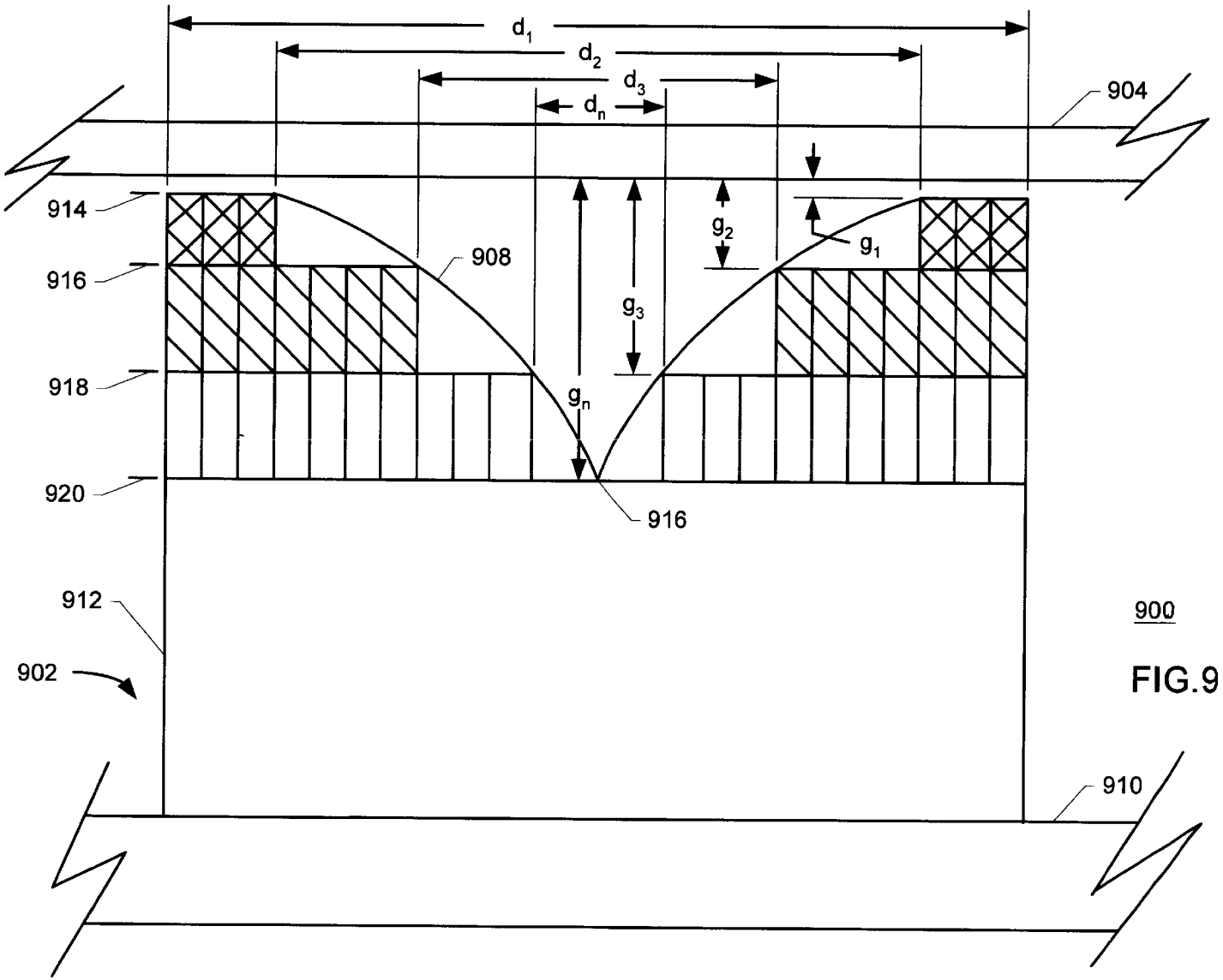
FIG. 9 is a side profile view of the adjusting effective core gap structure of the present invention illustrating the effect of varying current through an associated winding.

FIG. 9 is a side profile view of the adjustable effective core gap structure of the present invention illustrating the effect of varying current through an associated winding. In FIG. 9, a core component 900 includes a first core portion 902 and a second core portion 904. First core portion 902 includes a base member 910 and a post member 912. Post member 912 is a substantially cylindrical post integrally formed with base member 910 and extending from base member 910 toward second core portion 904. Post member 912 may be configured in a polyhedron-shaped structure or as a substantially planar structure. For ease of explaining the operation of the present invention, post member 912 is illustrated in FIG. 9 as a cylindrical structure. Post member 912 is illustrated in FIG. 9 in partial section generally along a diameter of post member 912.

Post member 912 is in spaced relation with second core portion 904 and establishes a first gap distance $g_1$ between post member 912 and second core portion 904. That is, post member 912 presents a first terminus, or structure, and second core portion 904 presents a second terminus, or structure, to establish first gap distance $g_1$ between post member 912 and second core portion 904. Post member 912 is configured with a variable depth construction establishing a first level 914 having a first diameter $d_1$. Post member 912 continuously varies its effective diameter to substantially zero along a continuous variance surface 908 to establish a maximum effective gap distance $g_n$ when the effective diameter is zero, substantially at center 916 of post structure 604.

When winding current in a winding associated with post member 912 (e.g., applied to windings 26, 56, 88; FIGS. 1–3) rises to an appropriate current level, post member 912 will locally saturate from first level 914 to a second level lower than first level 914. By way of example, post member 912 may continuously vary its effective diameter along continuous variance surface 908 to second level 916 to establish a second effective gap distance $g_2$ when the effective diameter is $d_2$. That is, there is formed in post structure 912 an annulus or ring structure (FIG. 7) displaced from second core structure 904. The annulus structure has a span $$\Delta_1 = \frac{(d_1 - d_2)}{2}.$$

It is this annulus structure that establishes magnetic coupling at an effective gap $g_2$ between post member 912 and second core portion 904.

A higher winding current will cause post member 912 to further locally saturate to a level lower than second level 916, such as third level 918 to establish a third effective gap distance $g_3$ when the effective diameter is $d_3$. That is, there is formed in post structure 912 an annulus or ring structure (FIG. 7) displaced from second core structure 904. The annulus structure has a span $$\Delta_2 = \frac{(d_1 - d_3)}{2}.$$

It is this annulus structure that establishes magnetic coupling at an effective gap $g_3$ between post member 912 and second core portion 904.

A still higher winding current will cause post member 912 to still further locally saturate to a level lower than third level 918, such as fourth level 920 to establish a fourth effective gap distance $g_n$ when the effective diameter is $d_n$. That is, there is formed in post structure 912 an annulus or ring structure (FIG. 7) displaced from second core structure 904. The annulus structure has a span $$\Delta_3 = \frac{(d_1 - d_4)}{2}.$$

It is this annulus structure that establishes magnetic coupling at an effective gap $g_n$ between post member 912 and second core portion 904. The subscript "n" is intended to emphasize that continuous variance surface 908 is not stepped, and an infinite number of gap distances $g_n$ may be achieved because of that continuous structure.

Given the continuous structure of variance surface 908 (i.e., variance surface 908 is not a stepped structure) any diameter between diameter $d_1$ and zero diameter, including diameter $d_2$, may be established to form respective annuli structures in post member 912, each respective annulus structure having a respective span $$\Delta_{n-1} = \frac{(d_1 - d_n)}{2}$$

and being separated from second core structure 904 by a respective effective gap distance $g_n$ without experiencing discrete diameter and effective gap distance changes. Such discrete diameter and effective gap distance changes would be experienced if variance surface 908 were fashioned in a stepped, non-continuous structure. In contrast with prior art attempts at adjusting effective gap core structures (e.g., core component 140, FIG. 5), true adjustment along a continuum (e.g., aggregate L-I response curve 120 (FIG. 4) is effected by post member 912 continuously varying its effective annular span $\Delta_{n-1}$ for respective gaps $g_n$ having respective depths $d_n$ along continuous variance surface 908.

As mentioned earlier, the power function (expression [7]) is described herein as an exemplary function by which to develop the requisite continuous variance surface 908 of the present invention. As mentioned earlier herein, any function may be used provided that:

$$0 \leqq x \leqq 1$$

$$0 \leqq f(x) \leqq 1$$

The important point is to develop a continuous variance surface for an adjusting effective gap structure for a ferrous core structure that will yield performance substantially conforming with the appropriate aggregate L-I response curve for the electromagnetic device being produced (e.g., aggregate L-I response curve 120; FIG. 4). Providing a continuous variance surface is also advantageous because it is amenable to a variety of manufacturing techniques for its creation, including but not limited to stamping, molding, swaging and other techniques for shaping and manipulating material.

It is to be understood that, while the detailed drawings and specific examples given describe preferred embodiments of the invention, they are for the purpose of illustration only, that the apparatus and method of the invention are not limited to the precise details and conditions disclosed and that various changes may be made therein without departing from the spirit of the invention which is defined by the following claims:

We claim:

1. An improved core apparatus for a magnetic device; the core apparatus having a first terminus and a second terminus; said first terminus and said second terminus cooperating to establish a gap across an expanse between said first terminus and said second terminus; said gap having a gap distance; said magnetic device including an inductive winding structure; said inductive winding structure cooperating with the core apparatus to establish a magnetic circuit having inductance; said inductance being variable with current applied to said inductive winding structure; said magnetic device having an optimum inductance-current locus for each said gap distance; respective said optimum inductance-current loci for selected said gap distances being expressible by an inductance-current curve; the improvement comprising: at least one terminus of said first terminus and said second terminus being configured to effect variance of effective said gap distance across said expanse; said variance effecting selective local saturation of successive portions of said at least one terminus; said selective local saturation establishing successive new effective gap distances; said successive new said effective gap distances establishing successive new optimum inductance-current loci closely approximating said inductance-current curve.

2. An improved core apparatus for a magnetic device as recited in claim 1 wherein said at least one terminus is one terminus of said first terminus and said second terminus.

3. An improved core apparatus for a magnetic device as recited in claim 2 wherein said first terminus presents a substantially planar first face segment to said zone and said second terminus is said at least one terminus; said successive portions being generally annular portions substantially parallel with said first face segment.

4. An improved core apparatus for a magnetic device as recited in claim 1 wherein said variance of said effective gap distance is a substantially continuous variance.

5. An improved electromagnetic apparatus; the apparatus including an inductive winding and a ferrous core; said core having a first terminus and a second terminus arranged in spaced relation to establish a gap distance between said first terminus and said second terminus in a region in substantial register with said first terminus and said second terminus; said winding and said core cooperating to establish an inductance; said inductance being related with an electrical current applied to said winding; the improvement comprising: at least one terminus of said first terminus and said second terminus having a configuration to effect variance of effective said gap distance across said region; said configuration responding to varying said current by effecting selective local saturation of successive portions of said at least one terminus for successive values of said current; said selective local saturation establishing successive new effective gap distances; each respective said new effective gap distance being appropriate for establishing a successive new optimum inductance for said current value then extant.

6. An improved electromagnetic apparatus as recited in claim 5 wherein said at least one terminus is one terminus of said first terminus and said second terminus.

7. An improved electromagnetic apparatus as recited in claim 6 wherein said first terminus presents a substantially planar first face segment to said region and said second terminus is said at least one terminus; said successive portions being generally annular portions substantially parallel with said first face segment.

8. An improved electromagnetic apparatus as recited in claim 5 wherein said variance of said effective gap distance is a substantially continuous variance.

9. An electromagnetic apparatus comprising:

(a) an electrical winding; and (b) a ferrous core situated proximal with said electrical winding; said core having a first terminus and a second terminus arranged in spaced relation to establish a gap distance between said first terminus and said second terminus in a region in substantial register with said first terminus and said second terminus; said winding and said core cooperating to establish an inductance; said inductance being related with an electrical current applied to said winding; at least one terminus of said first terminus and said second terminus having a configuration responsive to varying said current by effecting selective local saturation of successive portions of said at least one terminus for successive values of said current; said selective local saturation establishing successive new effective gap distances; each respective said new effective gap distance being appropriate for establishing a successive new optimum inductance for said current value then extant.

10. An electromagnetic apparatus as recited in claim 9 wherein said at least one terminus is one terminus of said first terminus and said second terminus.

11. An electromagnetic apparatus as recited in claim 10 wherein said first terminus presents a substantially planar first face segment to said region and said second terminus is said at least one terminus; said successive portions being generally annular portions substantially parallel with said first face segment.

12. An electromagnetic apparatus as recited in claim 9 wherein said variance of said effective gap distance is a substantially continuous variance.

* * * * *